US008371257B2

(12) United States Patent
Moon et al.

(10) Patent No.: US 8,371,257 B2
(45) Date of Patent: Feb. 12, 2013

(54) ENGINE WITH DUAL CAM PHASER FOR CONCENTRIC CAMSHAFT

(75) Inventors: Joseph J. Moon, Clawson, MI (US); Timothy L. Neal, Ortonville, MI (US)

(73) Assignee: GM Global Technology Operations LLC

( * ) Notice: Subject to any disclaimer, the term of this patent is extended or adjusted under 35 U.S.C. 154(b) by 416 days.

(21) Appl. No.: 12/720,917

(22) Filed: Mar. 10, 2010

(65) Prior Publication Data

US 2011/0220047 A1 Sep. 15, 2011

(51) Int. Cl.
*F01L 1/34* (2006.01)

(52) U.S. Cl. ..... 123/90.17; 123/90.15; 464/160

(58) Field of Classification Search ..... 123/90.15, 123/90.17; 464/1, 160
See application file for complete search history.

(56) References Cited

U.S. PATENT DOCUMENTS 7,841,311 B2 * 11/2010 Hutcheson et al. ..... 123/90.17
8,051,818 B2 * 11/2011 Myers et al. ..... 123/90.17
2009/0223470 A1 9/2009 Rozario et al.

* cited by examiner

*Primary Examiner* — Ching Chang
(74) *Attorney, Agent, or Firm* — Harness, Dickey & Pierce, P.L.C.

(57) ABSTRACT

A cam phaser assembly may include a first stator, a first rotor, a second stator and a second rotor. The first stator may be driven by an engine crankshaft. The first rotor may be coupled to a first end of a concentric camshaft and located within the first stator. The first rotor and the first stator may cooperate to define a first set of fluid chambers. The second stator may be fixed for rotation with the first rotor and the first shaft. The second rotor may be coupled to the first end of the concentric camshaft and fixed for rotation with the second shaft and located within the second stator. The second rotor and the second stator may cooperate to define a second set of fluid chambers.

20 Claims, 4 Drawing Sheets

ENGINE WITH DUAL CAM PHASER FOR CONCENTRIC CAMSHAFT

FIELD

The present disclosure relates to cam phasing in engines having concentric camshafts.

BACKGROUND

This section provides background information related to the present disclosure which is not necessarily prior art.

Engine assemblies may include a concentric camshaft assembly and a cam phaser to vary valve opening and closing. The cam phaser may adjust the rotational position of lobes of the concentric camshaft relative to one another. Controlling valve timing may provide increased fuel economy and/or engine torque and power output.

SUMMARY

An engine assembly may include an engine structure, a concentric camshaft rotationally supported on the engine structure and a cam phaser assembly. The concentric camshaft may include a first shaft having a first cam lobe fixed for rotation therewith and a second shaft rotatable relative to and coaxial with the first shaft and having a second cam lobe fixed for rotation therewith. The cam phaser assembly may include a first stator, a first rotor, a second stator and a second rotor. The first stator may be rotationally driven by an engine crankshaft. The first rotor may be coupled to a first end of the concentric camshaft and may be located within the first stator and rotatable relative thereto. The first rotor and the first stator may cooperate to define a first set of fluid chambers adapted to receive pressurized fluid for rotational displacement of the first rotor relative to the first stator. The second stator may be fixed for rotation with the first rotor and the first shaft. The second rotor may be coupled to the first end of the concentric camshaft and fixed for rotation with the second shaft and located within the second stator and rotatable relative thereto. The second rotor and the second stator may cooperate to define a second set of fluid chambers adapted to receive pressurized fluid for rotational displacement of the second rotor relative to the second stator.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
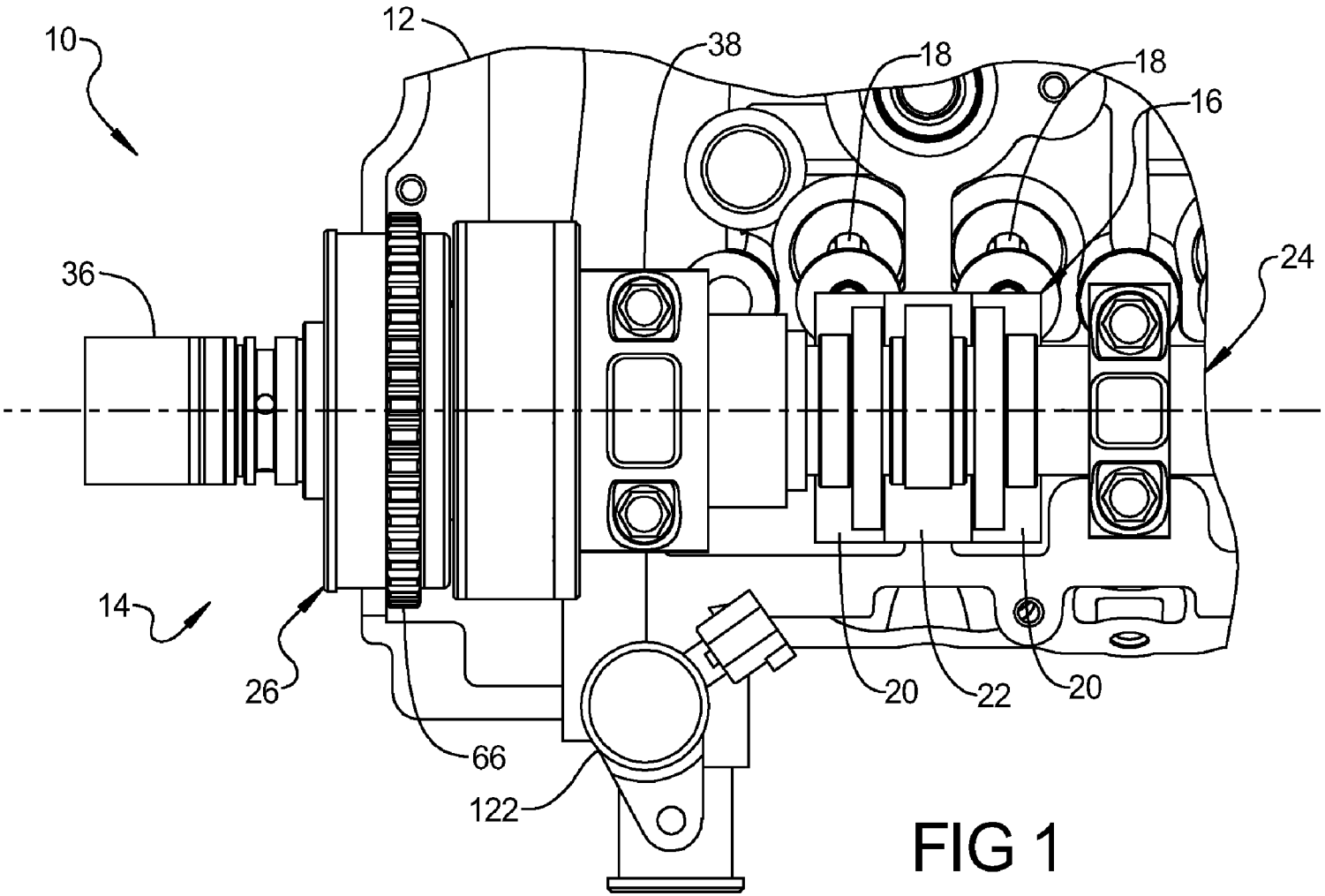
FIG. 1 is a fragmentary plan view of an engine assembly according to the present disclosure.

With reference to FIG. 1, an engine assembly 10 is illustrated. The engine assembly 10 may include an engine structure 12, a concentric camshaft assembly 14, a valve lift assembly 16 and valves 18. In the present non-limiting example, the engine assembly 10 is shown as an overhead camshaft engine. The present disclosure applies equally to intake and exhaust camshaft assemblies. It is further understood that the present disclosure is not limited to overhead camshaft arrangements and applies equally to cam-in-block arrangements where a single camshaft includes both intake and exhaust lobes.

The engine structure 12 may include a cylinder head rotationally supporting the concentric camshaft assembly 14 and supporting the valve lift assembly 16 and valves 18. The valve lift assembly 16 may include a multi-step rocker arm including outer arms 20 engaged with the valves 18 and an inner arm 22. The valve lift assembly 16 may be operable in a first mode where the outer arms 20 are displaceable relative to the inner arm 22 and a second mode where the outer arms 20 are fixed for displacement with the inner arm 22. However, the present disclosure is not limited to such arrangements and applies equally to a variety of other valve lift arrangements including, but not limited to, independent lift mechanisms for each valve 18.

Figure 2:
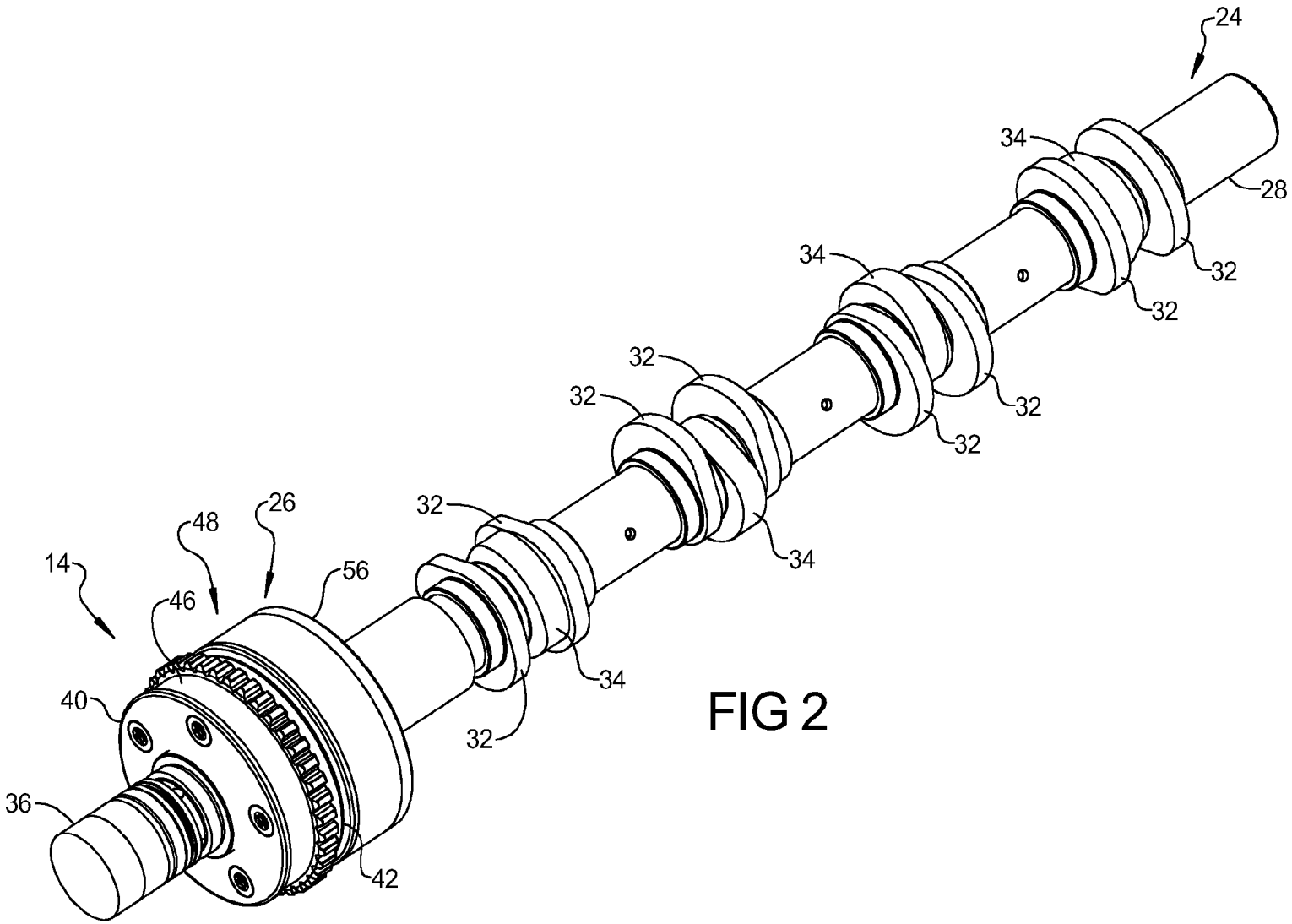
FIG. 2 is a perspective view of the concentric camshaft assembly shown in FIG. 1.
Figure 3:
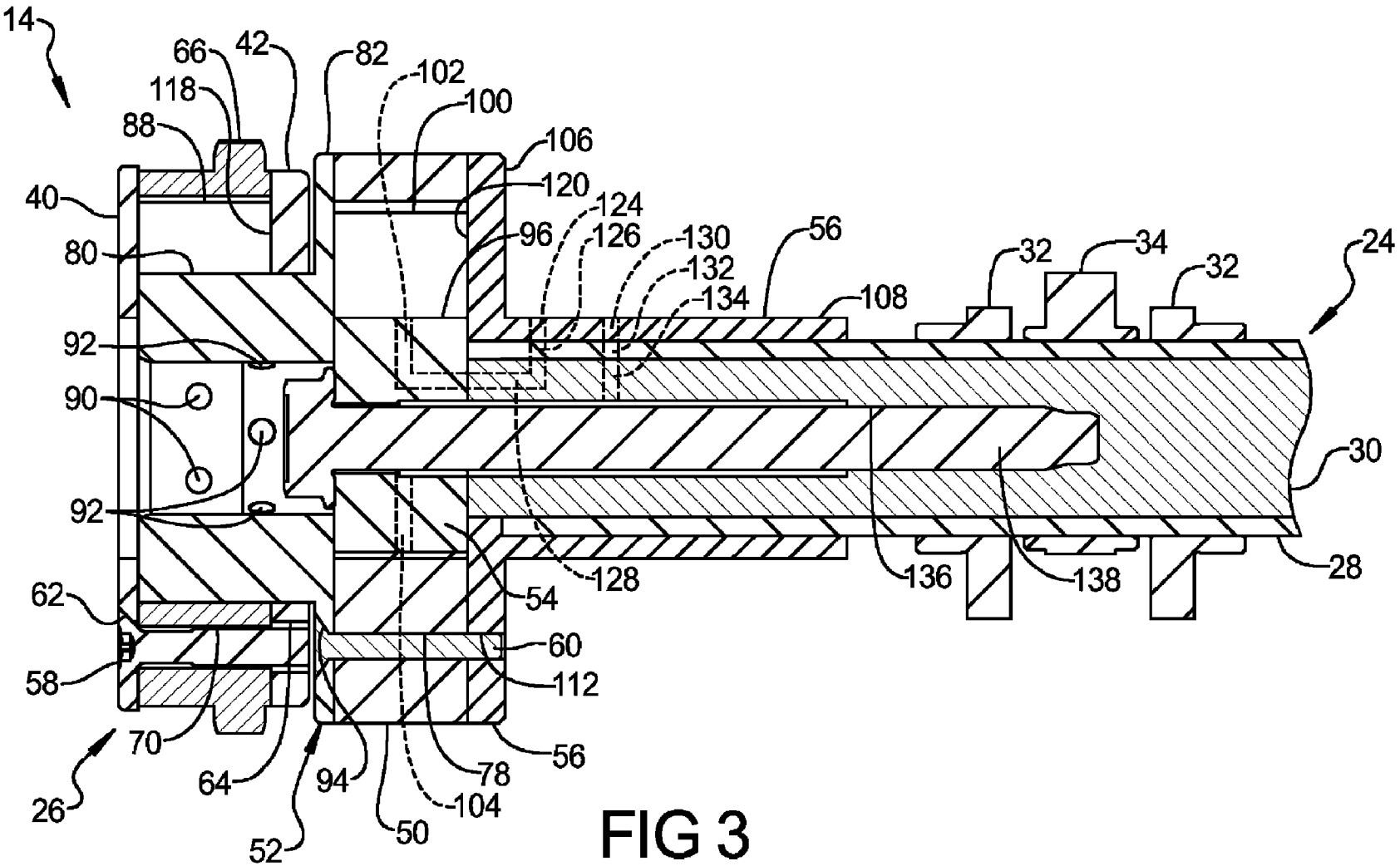
FIG. 3 is a fragmentary section view of the concentric camshaft assembly shown in FIG. 1.
Figure 4:
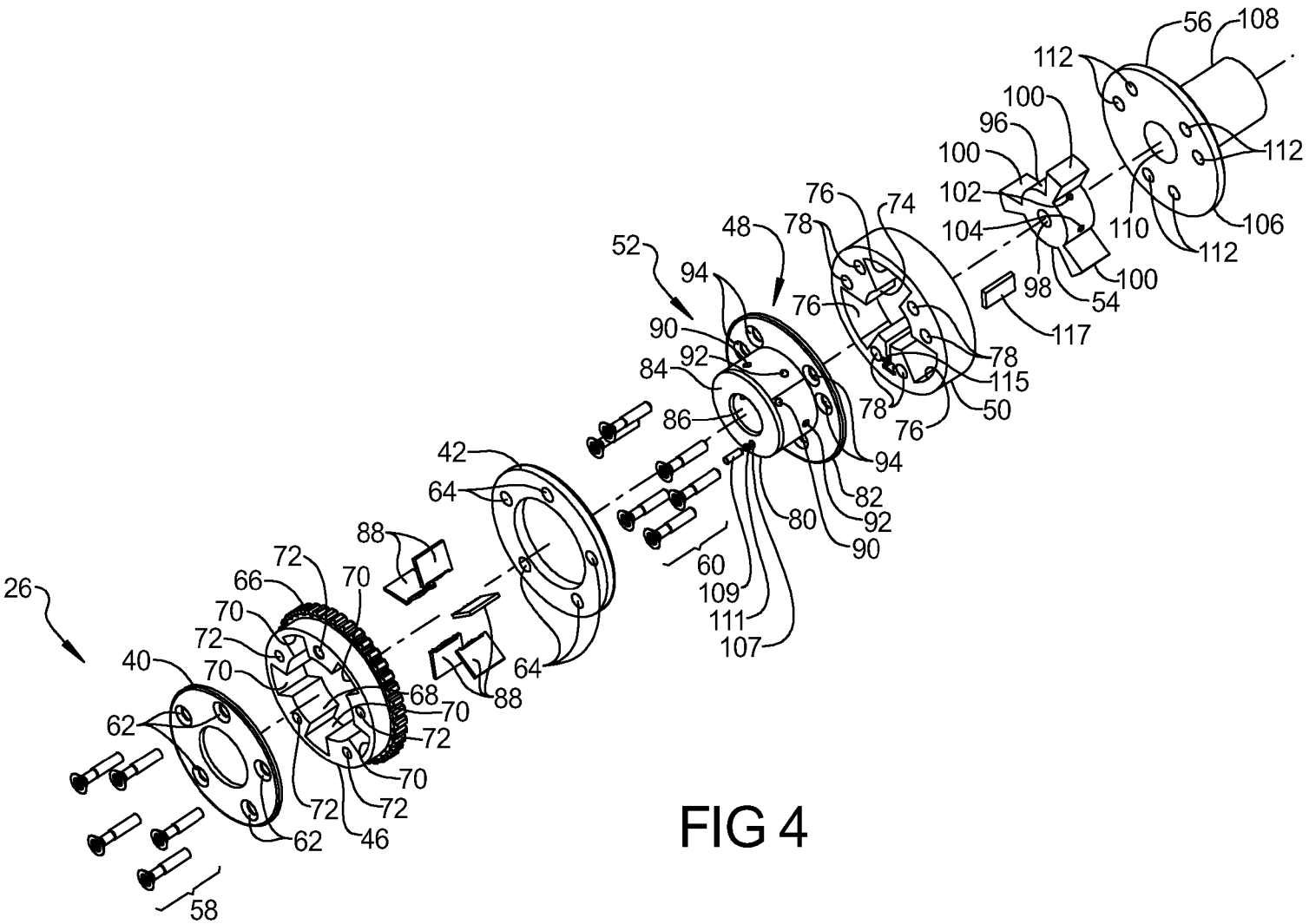
FIG. 4 is an exploded view of the cam phaser assembly shown in FIG. 1.

With additional reference to FIGS. 2-4, the concentric camshaft assembly 14 may include a concentric camshaft 24 and a cam phaser assembly 26. The cam phaser assembly 26 may be coupled to a first end of the concentric camshaft 24. The concentric camshaft 24 may include first and second shafts 28, 30 and first and second sets of lobes 32, 34. The second shaft 30 may be coaxial with and rotatable relative to the first shaft 28. More specifically, the second shaft 30 may be rotationally supported within the first shaft 28.

The first set of lobes 32 may be fixed for rotation with the first shaft 28 and the second set of lobes 34 may be rotatable relative to the first shaft 28 and fixed for rotation with the second shaft 30. In the present non-limiting example, the first and second sets of lobes 32, 34 are illustrated as either all intake lobes or all exhaust lobes. However, as indicated above, the present disclosure is not limited to such arrangements and applies equally to configurations where the lobes form both intake and exhaust lobes, as well as any other camshaft arrangement having first and second lobes that are rotatable relative to one another. By way of non-limiting example, a first one of lobes 32 may be fixed to the first shaft 28 and a second one of lobes 32 may be fixed to the second shaft 30 in arrangements having independent lift mechanisms for each valve 18.

The cam phaser assembly 26 may include first and second oil supply members 36, 38, first and second end plates 40, 42, a first stator 46, a rotor/stator assembly 48 including a second stator 50 and a first rotor 52, a second rotor 54, an end cap 56, and first and second sets of fasteners 58, 60. The first end plate 40 may define a first set of apertures 62 and the second end plate 42 may define a second set of apertures 64.

The first stator 46 may be rotationally driven by an engine crankshaft (not shown). By way of non-limiting example, the first stator 46 may include gear teeth 66 extending from an outer perimeter for driven engagement with a chain drive (not shown). The first stator 46 may further include a bore 68 having recesses 70 extending radially therefrom and apertures 72 located between the recesses 70. Similarly, the second stator 50 include a bore 74 having recesses 76 extending radially therefrom and apertures 78 located between the recesses 76.

The first rotor 52 may include first and second portions 80, 82. The first portion 80 may include an annular body 84 defining an axial bore 86 and vanes 88 extending from an outer radial surface of the annular body 84. While illustrated as having separate vanes 88 fixed to the annular body 84, it is understood that the present disclosure applies equally to arrangements having vanes 88 integrally formed on the annular body 84. The annular body 84 may define retard and advance passages 90, 92. The second portion 82 may extend radially outward from the first portion 80 and may form a flange defining apertures 94. The second rotor 54 may include an annular body 96 defining a threaded axial bore 98 and vanes 100 extending from an outer radial surface of the annular body 84. The annular body 84 may define retard and advance passages 102, 104. The end cap 56 may include a flange 106 defining apertures 112 and a cylindrical portion 108 defining an axial bore 110.

An end of the annular body 84 of the first rotor 52 may define an axial bore 107 housing a lock pin 109 and a biasing member 111. The biasing member 111 may urge the lock pin 109 into a recess (not shown) in the first end plate 40 to fix the first stator 46 and the first rotor 52 for rotation with one another. The lock pin 109 may be displaced from the first end plate 40 by fluid pressure, as discussed below.

The second stator 50 may define a slot 115 housing a lock vane 117 and a biasing member (not shown). The biasing member may urge the vane 117 radially inward into a corresponding slot in the second rotor 54 to fix the second stator 50 and the second rotor 54 for rotation with one another. The vane 117 may be displaced from the second rotor 54 by fluid pressure, as discussed below.

When assembled, the first stator 46 may be located axially between the first and second end plates 40, 42. The first set of fasteners 58 may extend through the apertures 62, 72, 64 of the first end plate 40, first stator 46 and second end plate 42 and fix the first end plate 40, first stator 46 and second end plate 42 for rotation with one another. The first portion 80 of the first rotor 52 may be located within the bore 68 defined by the first stator 46 and the vanes 88 may extend into the recesses 70 of the first stator 46. The first and second end plates 40, 42, the first stator 46 and the first rotor 52 may cooperate to define fluid chambers 118. The fluid chambers 118 may be separated into advance and retard regions by the vanes 88. The advance regions may be in fluid communication with the advance passages 92 in the first rotor 52 and the retard regions may be in communication with the retard passages 90 in the first rotor 52. One of the fluid chambers 118 may be in communication with the lock pin 109 to displace the lock pin 109 from the first end plate 40 and allow relative rotation between the first stator 46 and the first rotor 52.

The second stator 50 may be located axially between the first rotor 52 and the end cap 56. The second set of fasteners 60 may extend through the apertures 94, 78, 112 of the first rotor 52, second stator 50 and end cap 56 and fix the first rotor 52, second stator 50 and end cap 56 for rotation with one another. The second rotor 54 may be located within the bore 74 defined by the second stator 50 and the vanes 100 may extend into the recesses 76 of the second stator 50. The second stator 50, the first and second rotors 52, 54 and the end cap 56 may cooperate to define fluid chambers 120. The fluid chambers 120 may be separated into advance and retard regions by the vanes 100. The advance regions may be in fluid communication with the advance passages 104 in the second rotor 54 and the retard regions may be in communication with the retard passages 102 in the second rotor 54. One of the fluid chambers 120 may be in communication with the lock vane 117 to displace the lock vane 117 from the second rotor 54 and allow relative rotation between the second stator 50 and the second rotor 54.

The first oil supply member 36 may provide pressurized oil flow from an oil control valve (not shown) to the retard and advance passages 90, 92 in the first rotor 52. The second oil supply member 38 may provide pressurized oil flow from an oil control valve 122 (FIG. 1) to the retard and advance passages 102, 104 in the second rotor 54. Oil may be provided to the advance passage 104 via passages 124, 126, 128 in the end cap 56, first shaft 28 and second shaft 30, respectively. Oil may be provided to the retard passage 102 via passages 130, 132, 134 in the end cap 56, first shaft 28 and second shaft 30, respectively.

In the present non-limiting example, the first shaft 28 may be fixed for rotation with the first rotor 52 and the second shaft 30 may be fixed for rotation with the second rotor 54. The first shaft 28 may be rotationally fixed within the bore 110 of the end cap 56. The second shaft 30 may include a threaded bore 136 and a fastener 138 may extend through the bore 98 in the second rotor 54 and into the bore 136 of the second shaft 30, fixing the second shaft 30 for rotation with the second rotor 54.

During operation, the first rotor 52 may rotationally advance and retard the concentric camshaft 24. Rotation of the first rotor 52 may rotate both the first and second shafts 28, 30. The second shaft 30 may be rotated (advanced/retarded) relative to the first shaft 28 by the second stator 54. The separate first and second stators 46, 50 may provide increased phasing authority for the concentric camshaft 24. By way of non-limiting example, the first rotor 52 may be capable of adjusting the angular position of the first shaft 28 by at least twenty degrees, and more specifically by up to thirty degrees. By way of non-limiting example, the second rotor 54 may be capable of adjusting the angular position of the second shaft 30 by at least twenty degrees, and more specifically by up to seventy degrees.

What is claimed is:

1. A cam phaser assembly comprising:

a first stator adapted to be rotationally driven by an engine crankshaft;

a first rotor adapted to be coupled to a first end of a camshaft and located within the first stator and rotatable relative thereto, the first rotor and the first stator cooperating to define a first set of fluid chambers adapted to receive pressurized fluid for rotational displacement of the first rotor relative to the first stator;

a second stator fixed for rotation with the first rotor; and a second rotor adapted to be coupled to the first end of the camshaft and located within the second stator and rotatable relative thereto, the second rotor and the second stator cooperating to define a second set of fluid chambers adapted to receive pressurized fluid for rotational displacement of the second rotor relative to the second stator.

2. The cam phaser assembly of claim 1, wherein the first rotor includes a first portion defining a first set of vanes located within the first stator and a second portion defining a first flange extending radially outward from the first portion and located external to the first stator, the second portion located axially between the first and second stators and cooperating with the second stator and second rotor to define the second set of fluid chambers.

3. The cam phaser assembly of claim 2, further comprising a fastener extending through the second portion of the first rotor and the second stator and rotationally fixing the first rotor and the second stator to one another.

4. The cam phaser assembly of claim 3, further comprising an end cap defining a second flange and a cylindrical portion extending axially from a first side of the second flange and defining a bore adapted to receive the first end of the camshaft therein, the fastener extending through the second flange and rotationally fixing the end cap to the first rotor and the second stator.

5. The cam phaser assembly of claim 4, wherein the first flange abuts a first axial end of the second stator and a second side of the second flange abuts a second axial end of the second stator defining the second set of fluid chambers axially between the first and second flanges.

6. The cam phaser assembly of claim 1, wherein the second stator is adapted to be rotationally fixed to a first shaft of a concentric camshaft at the first end of the concentric camshaft and the second rotor is adapted to be rotationally fixed to a second shaft of the concentric camshaft.

7. A concentric camshaft assembly comprising:

a concentric camshaft including:

a first shaft having a first cam lobe fixed for rotation therewith; and a second shaft rotatable relative to and coaxial with the first shaft and having a second cam lobe fixed for rotation therewith; and a cam phaser assembly including:

a first stator adapted to be rotationally driven by an engine crankshaft;

a first rotor coupled to a first end of the concentric camshaft and located within the first stator and rotatable relative thereto, the first rotor and the first stator cooperating to define a first set of fluid chambers adapted to receive pressurized fluid for rotational displacement of the first rotor relative to the first stator;

a second stator fixed for rotation with the first rotor and the first shaft; and a second rotor coupled to the first end of the concentric camshaft and fixed for rotation with the second shaft and located within the second stator and rotatable relative thereto, the second rotor and the second stator cooperating to define a second set of fluid chambers adapted to receive pressurized fluid for rotational displacement of the second rotor relative to the second stator.

8. The concentric camshaft assembly of claim 7, wherein the second shaft is rotationally disposed within the first shaft.

9. The concentric camshaft assembly of claim 8, wherein the second stator is fixed to a first end of the first shaft and located axially between the first end of the first shaft and first rotor.

10. The concentric camshaft assembly of claim 8, further comprising a fastener extending through the second rotor and into the second shaft and rotationally fixing the second rotor and second shaft to one another.

11. The concentric camshaft assembly of claim 7, wherein the first rotor includes a first portion defining a first set of vanes located within the first stator and a second portion defining a first flange extending radially outward from the first portion and located external to the first stator, the second portion located axially between the first and second stators and cooperating with the second stator and second rotor to define the second set of fluid chambers.

12. The concentric camshaft assembly of claim 11, further comprising a fastener extending through the second portion of the first rotor and the second stator and rotationally fixing the first rotor and the second stator to one another.

13. The concentric camshaft assembly of claim 12, further comprising an end cap defining a second flange and a cylindrical portion extending axially from a first side of the second flange and defining a bore adapted to receive the first end of the camshaft therein, the fastener extending through the second flange and rotationally fixing the end cap to the first rotor and the second stator.

14. The concentric camshaft assembly of claim 13, wherein the first flange abuts a first axial end of the second stator and a second side of the second flange abuts a second axial end of the second stator defining the second set of fluid chambers axially between the first and second flanges.

15. An engine assembly comprising:

an engine structure;

a concentric camshaft rotationally supported on the engine structure and including:

a first shaft having a first cam lobe fixed for rotation therewith; and a second shaft rotatable relative to and coaxial with the first shaft and having a second cam lobe fixed for rotation therewith; and a cam phaser assembly including:

a first stator adapted to be rotationally driven by an engine crankshaft;

a first rotor coupled to a first end of the concentric camshaft and located within the first stator and rotatable relative thereto, the first rotor and the first stator cooperating to define a first set of fluid chambers adapted to receive pressurized fluid for rotational displacement of the first rotor relative to the first stator;

a second stator fixed for rotation with the first rotor and the first shaft; and a second rotor coupled to the first end of the concentric camshaft and fixed for rotation with the second shaft and located within the second stator and rotatable relative thereto, the second rotor and the second stator cooperating to define a second set of fluid chambers adapted to receive pressurized fluid for rotational displacement of the second rotor relative to the second stator.

16. The engine assembly of claim 15, wherein the second stator is fixed to a first end of the first shaft and located axially between the first end of the first shaft and first rotor.

17. The engine assembly of claim 16, further comprising a fastener extending through the second rotor and into the second shaft and rotationally fixing the second rotor and second shaft to one another.

18. The engine assembly of claim 15, wherein the first rotor includes a first portion defining a first set of vanes located within the first stator and a second portion defining a first flange extending radially outward from the first portion and located external to the first stator, the second portion located axially between the first and second stators and cooperating with the second stator and second rotor to define the second set of fluid chambers.

19. The engine assembly of claim 18, further comprising an end cap and a fastener, the end cap defining a second flange and a cylindrical portion extending axially from a first side of the second flange and defining a bore adapted to receive the first end of the concentric camshaft therein, the fastener extending through the second portion of the first rotor, the second stator, and the second flange and rotationally fixing the first rotor, the second stator, and the end cap to one another.

20. The engine assembly of claim 19, wherein the first flange abuts a first axial end of the second stator and a second side of the second flange abuts a second axial end of the second stator defining the second set of fluid chambers axially between the first and second flanges.

* * * * *